United States Patent [19]

Siryj et al.

[11] 4,293,212

[45] Oct. 6, 1981

[54] THERMAL PROCESSOR IN AN APPARATUS FOR DEVELOPING PHOTOGRAPHIC FILM

[75] Inventors: Bohdan W. Siryj, Cinnaminson; Richard D. Scott, Cherry Hill; Charles R. Horton, Maple Shade, all of N.J.

[73] Assignee: RCA Corporation, New York, N.Y.

[21] Appl. No.: 790,196

[22] Filed: Apr. 25, 1977

[51] Int. Cl.[2] ..... G03D 7/00

[52] U.S. Cl. ..... 354/299; 354/300; 34/155; 219/216; 219/388

[58] Field of Search ..... 354/297, 299, 300, 317, 354/319, 339; 34/155, 160; 432/59; 219/216, 388

[56] References Cited

U.S. PATENT DOCUMENTS

| | | | |
|---|---|---|---|
| 3,041,740 | 7/1962 | Allen | 34/160 |
| 3,496,332 | 2/1970 | Lunde | 219/216 |
| 3,585,917 | 6/1971 | Griffith | 354/297 |
| 3,727,534 | 4/1973 | Low et al. | 354/300 |
| 3,851,403 | 12/1974 | Maurischat et al. | 34/155 |
| 4,052,732 | 10/1977 | Meadows | 354/297 |

*Primary Examiner*—L. T. Hix
*Assistant Examiner*—Alan Mathews
*Attorney, Agent, or Firm*—Samuel Cohen; Joseph D. Lazar

[57] ABSTRACT

A thermal processor in an apparatus for heat development of a fixed photographic image on a photographic film wherein the film includes a latent image formed on an emulsion layer coated on a film base. The apparatus comprises a housing arranged to receive uniformly heated flowing air. Porous members responsive to the air flow are disposed adjacent both surfaces of the film to uniformly distribute the heated air to the surfaces of the film at a predetermined pressure. The porous members are disposed at a spacing from the respective film surfaces such that the pressure of the gas supplied to the film establishes a gas bearing to support the film as it passes through the processor. The spacing is also arranged such that heat is transferred from the processor to the film essentially by heat conduction to develop the fixed photographic image on the film.

5 Claims, 6 Drawing Figures

THERMAL PROCESSOR IN AN APPARATUS FOR DEVELOPING PHOTOGRAPHIC FILM

CROSS REFERENCE TO RELATED APPLICATIONS

Of interest is the following copending application Ser. No. 790,662, filed on Apr. 25, 1977, entitled "Apparatus for Developing Photographic Images on an Emulsion Coated Film," based on the invention of Richard David Scott and assigned to the same assignee as is the present invention.

BACKGROUND OF THE INVENTION

1. Field of the Invention

This invention relates to a thermal processor in an apparatus for developing photographic film and more particularly to a thermal processor which conductively heats the film and supports the film by a controlled flow of gas.

2. Description of the Prior Art

In photographic systems it is often desirable to visually display photographic images in a short time subsequent to the forming of the images on a sensitized photographic surface. Such photographic systems are useful, for example, in reconaissance and weather applications, aircraft and space use and commercial systems requiring fast display response. In these systems, dry development of photographic images on the sensitized film by thermal processing subsequent to exposure of the sensitized surface to light generally can be more time consuming than the exposure process.

In a conventional device for developing photographic images, a light-sensitive, heat-developable emulsion layer such as a dry silver halide is coated on a suitable film base or support. The dry silver emulsion contains photosensitive silver halide, an organic silver salt, and a reducing agent. Exposure to a light-image generates from the silver halide component a catalyst which accelerates the image-forming reaction between the other two components to make possible the subsequent heat development of the visable image. The typical dry silver film development temperature range of these conventional thermal processing devices is about 210°–330° F. (99°–166° C.), and generally the development time is for 30 seconds at 260° F. (127° C.).

Since the photographic film development is a chemical reaction, the development time can be shortened by raising the processing temperature. However, thermal warping and weakening of the base can occur in the film base at temperatures in excess of 330° F. (166° C.). Furthermore, contacting the emulsion at a temperature in excess of 330° F. (166° C.) is not desirable since the emulsion is relatively soft and more easily damaged. Thus, standard film development devices utilizing "hot" rollers for thermal processing which contact the emulsion of the film are inadequate for reducing the film development time by use of higher temperature processing. Moreover, development devices employing thermal radiation or convective heat transfer mediums often lack the control of localized heating and accurate maintenance of temperature levels to satisfactorily provide uniform film development minimizing film density variations or to effectively reduce the time of film development.

SUMMARY OF THE INVENTION

According to the present invention, a thermal processor in an apparatus for heat development of a fixed photographic image on a strip of photographic film is provided. The film includes a latent image formed on an emulsion layer coated on a film base. The processor includes means for heating a supply of gas to a substantially uniform predetermined temperature and a housing arranged to receive the gas. Also included are means for supplying the gas to the housing and gas distribution means responsive to the supply means for uniformly distributing the gas to the film at a predetermined pressure. The gas distribution means is supported by the housing and disposed adjacent to and on opposite surfaces of the film at a spacing such that the pressure of gas supplied to the film surfaces is sufficient to establish a gas bearing on the respective film surfaces to thereby support the film. The gas distribution means is also spaced with respect to the respective film surfaces to transfer heat from the heating means to the film by essentially heat conduction. The heated gas essentially conductively heats both surfaces of the film uniformly for development of the fixed photographic image.

DETAILED DESCRIPTION OF THE PREFERRED EMBODIMENT

Figure 1:
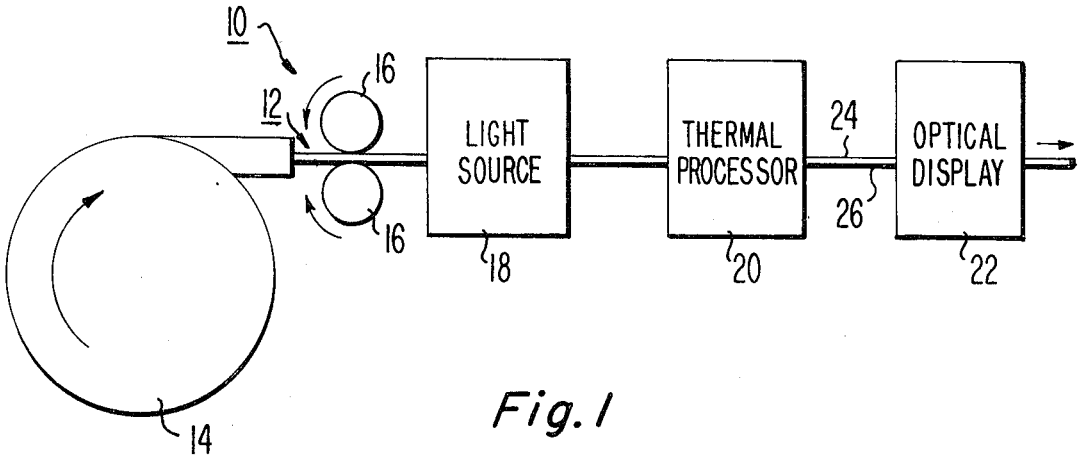
FIG. 1 is a schematic representation of a photographic film development apparatus incorporating the present invention.

Referring to the drawing there is shown in FIG. 1 a schematic representation of a photographic film development apparatus 10. A photographic film 12 is fed from a supply cassette 14 into a film development apparatus 10 such as described in the above-identified application, Ser. No. 790,662. Film 12 passes through a pair of drive rollers 16 serving as a mechanism to convey film 12 through apparatus 10. Film 14, photothermally sensitized, as will be described subsequently, passes through a light source 18 preferably a confined laser beam. During the exposure to light at light source 18, a latent image is recorded on film 12. The exposed film 12 then passes through a suitable heat source termed herein a thermal processor 20 to develop a fixed photographic negative image which may be visually displayed on an optical display 22. According to the invention, by changing the electronic logic of the laser beam recorder, a positive image may also be developed. The thermal processor of this invention, now to be described in detail, is generally applicable in any photographic system which utilizes heat-processing for image development and which does not require application of external liquid developing agents.

Figure 2:
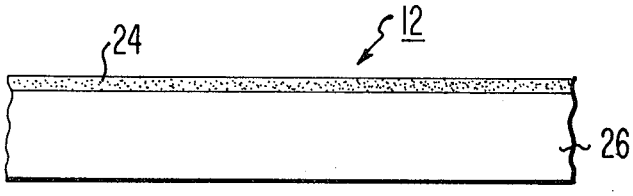
FIG. 2 is a fragmentary side elevation view of a photographic film utilized in the present invention.

As depicted in FIG. 2, photographic film 12 comprises a layer 24 of light sensitive and heat developable emulsion coated on a suitable support or base 26. Emulsion 24 may be a dry silver material comprising an oxidizing agent, such as a heavy metal salt, a reducing agent and a photosensitive component, such as photosensitive silver halide which serves as a catalyst for the oxidation reduction image forming combination. A useful photosensitive material comprises, for example, an oxidation-reduction image forming combination comprising (i) silver behenate and/or silver stearate with (ii) a reducing agent, such as a bis-beta-naphthol and photosensitive silver halide. Other suitable image producing emulsions may, however, also be used.

Emulsion 24 can be coated on a base 26 of a wide variety of material according to usual practice. Typical base materials for photographic film include glass, metal, paper, cellulose, triacetate, polyethelene terephthalate and film bases having high heat-distortion temperatures suitable for providing a film support for heat-fixing image development.

Figure 3:
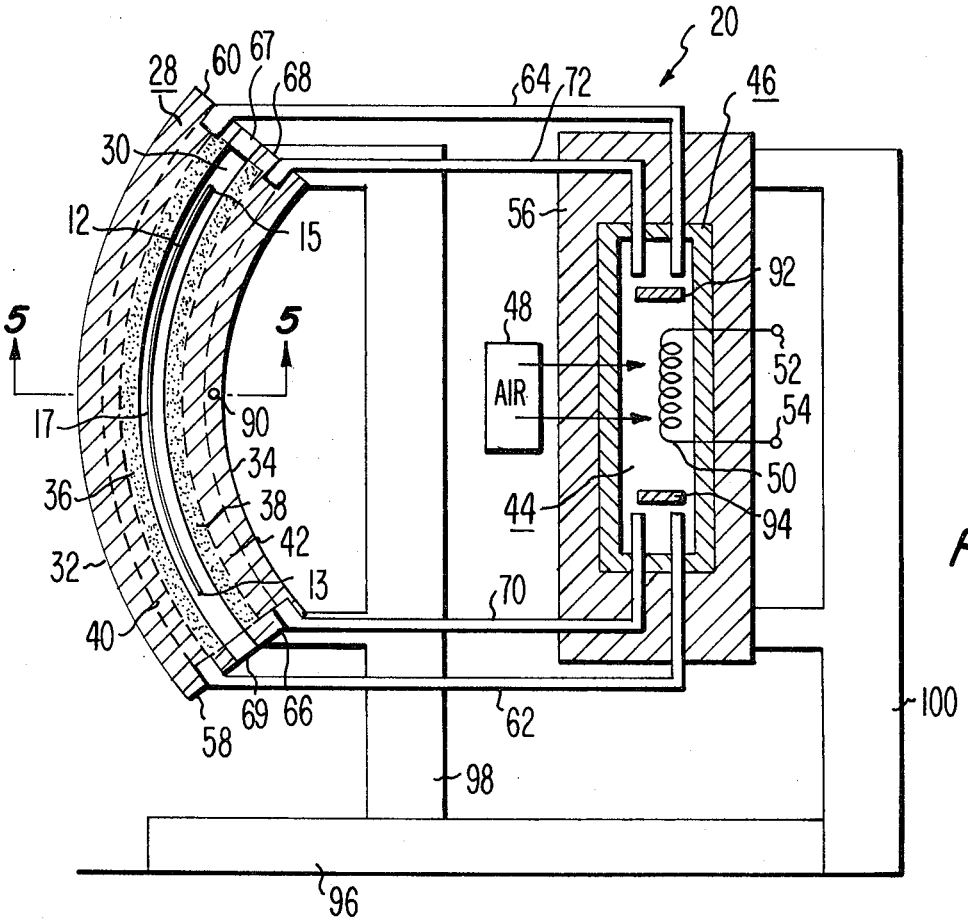
FIG. 3 is a diagrammatic view, partly in cross-section, of a thermal processor according to one embodiment of the invention.

A preferred embodiment of the thermal processor 20 of the invention is shown in detail in FIG. 3. Processor 20 comprises a housing 28 having an aperture 30 through which film 12 is continually passed. Housing 28 is preferably formed of metal formed in an arcuate configuration having a substantially rectangular cross section in the direction of the film movement. Any rigid non-porous material formed in a suitable geometric configuration may be used for housing 28. As shown in FIG. 3, the length of film 12 is passed into or out from the plane of the drawing and housing 28 and aperture 30 are formed to freely receive the width of film 12. In the particular embodiment being described, housing 28 is curved to accommodate a wide film within a confined space. The geometric configuration of housing 28 in general depends upon the space available as well as the method of laser recording of the latent image. In particular, on aircraft where space is limited, curving of the housing structure may be utilized to reduce the space required to mount thermal processor 20 to the airframe. Also, in the particular embodiment being described, the recording of the latent image is acheived by scanning a laser beam across the width of the film 12. Depending upon the width of the film the width being for example 9 inches (22.9 cm.), image recording may be more accurately and easily accomplished by pivotal scanning. Such pivotal scanning requires a curved film surface to maintain uniform light intensity across the width of the film. It should be understood however, that depending upon the conditions and applications other suitable non-curved housing shapes may also be used.

Figure 5:
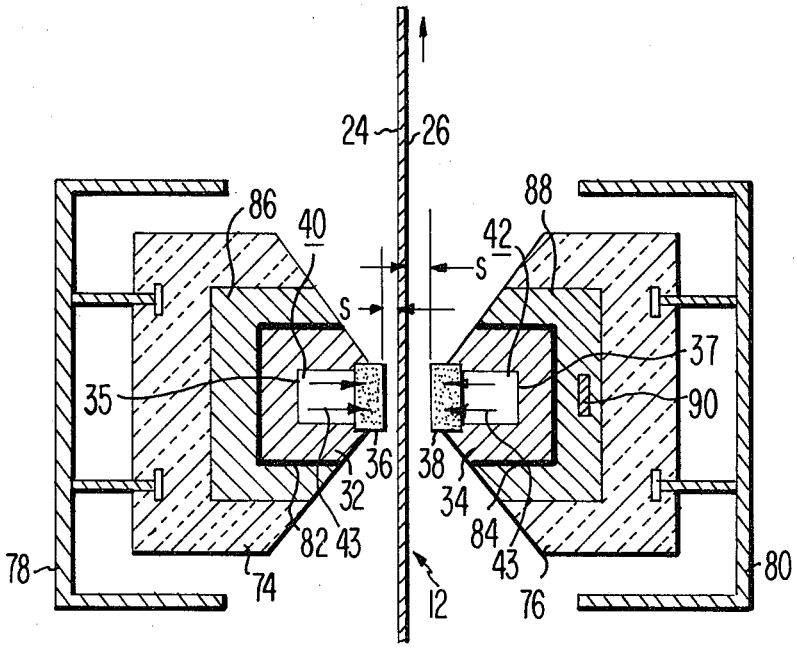
FIG. 5 is a simplified cross-sectional view of the thermal processor of FIG. 3 as seen along viewing line 5—5 of FIG. 3, but including additional structure now shown in FIG. 3.

Aperture 30 effectively divides housing 28 into a first portion 32 which is disposed on one side of film 12, for example the emulsion side 24, and into a second portion 34 disposed on the opposite side 26 of film 12. As shown in FIG. 5, a channel 35 is formed throughout the curved width of first portion 32. A first porous member 36 is attached to first portion 32 to enclose channel 35 forming thereby a chamber 40 extending the width of housing 32. Porous member 36 is disposed closely adjacent to the emulsion side 24 of film 12. A channel 37 similar to channel 35 is formed in housing portion 34 and a second porous member 38 is attached to portion 34 to enclose channel 37, forming thereby a chamber 42 extending throughout the width of portion 34. Porous member 38 is also disposed closely adjacent to the film base 26 of film 12. The spacing between the film and the members 36 and 38 are critical as will be explained further. Porous members 36 and 38 may be formed of porous material such as, for example, ceramic or graphite.

A controllable flow of air or any other suitable gas is supplied into a cavity 44 of a heating station 46 (FIG. 3) by an air blower 48. Blower 48 has provisions (not shown) for adjusting the flow rate of ambient air supplied to cavity 44. Blower 48 provides pressurized air to cavity 44 such that a "stiff air film" is produced to support film 12, as will be explained. The air is preferably heated by a heating element 50 having external terminals 52 and 54 for connection to a source of electrical energy (not shown) to heat element 50. Station 46 preferably has a layer of insulation 56 surrounding cavity 44 to reduce the loss of heat from cavity 44.

The air, heated by element 50 to a temperature selected for film development is supplied to the interior of housing 28 so as to heat film 12 and develop the fixed photographic image. In a preferred embodiment of the invention, the heated air is supplied to chamber 40 at both ends 58 and 60 (FIG. 3) of housing portion 32 through pipes 62 and 64, respectively. Similarly, the heated air is supplied to chamber 42 at both ends 66 and 68 of housing portion 34 through pipes 70 and 72, respectively. It should be understood that the heated air may be supplied to chambers 40 and 42 at one end of the housing portions when the housing ends are insulated to minimize heat losses to the ambient. Loss of heat at the housing ends tends to cause a nonuniform temperature profile across the width of film 12. Where suitable insulation at the housing ends is difficult or impossible to implement the effect of the heat loss at the housing ends is compensated by the introduction of air at both housing ends as will be explained with reference to FIG. 6. Preferably, pipes 62, 64, 70 and 72 have a relatively small diameter to provide a flow of turbulent air at a suitable flow rate to chambers 40 and 42. In turbulent air flow, there are throughout the fluid random, irregular, local circular currents, called vortices, resulting in a mixing action of the fluid. The fluid supplied to chambers 40 and 42 under turbulent conditions will be more uniform in temperature than fluid supplied under laminar conditions.

Figure 4:
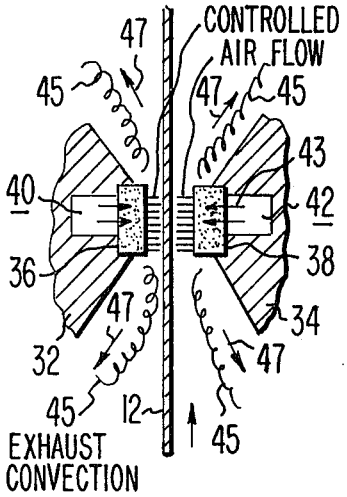
FIG. 4 is a fragmented view of FIG. 3 showing a controlled air flow on both sides of a photographic film.

The air supplied to chambers 40 and 42 flows under pressure at substantially uniform temperature through porous members 36 and 38 as shown by the arrows 43 in FIG. 5. Porous members 36 and 38 distribute air to both sides 24 and 26 of film 12, the air distribution being substantially uniform over the surface of film 12 adjacent porous members 36 and 38. As shown in more detail in FIG. 4, the controlled air flow impinges upon film 12 with uniform distribution. After striking film 12, the exhausted air freely dissipates along film 12 as by the flow paths 45 in the direction of arrow 47.

Porous members 36 and 38 are positioned such that a relatively small spacing (s—FIG. 5) preferably in the order of 0.001–0.002 inch (0.0254–0.0508 mm.) is between members 36 and 38 and film 12. At such a small spacing, the uniformly distributed air at the substantially uniform temperature heats film 12 by conduction more than by convection. It has been empirically determined that when the spacing s is less than approximately 0.02 inch (0.508 mm.), heat transfer is more conductive than convective for air uniformly passing through porous members 36 and 38. Furthermore, the air flowing through porous members 36 and 38 is under sufficient pressure to provide a gas bearing to support and suspend film 12 as it passes through processor 20 such that film 12 does not contact any surface during image development. The air flow after passing through porous members 36 and 38 is typically laminar due to the restrictive passage of air through the interstices of members 36 and 38, even when the flow in chambers 40 and 42 is turbulent.

A gas bearing of about 0.002 inch (0.0508 mm.) or less through porous members 36 and 38 formed of graphite can be achieved in accordance with one embodiment of the invention at the following conditions determined empirically: input air pressure of 20 pounds per square inch gage (psig) (1.406 kgs/square centimeters); pipe inner diameter of 0.030 inch (0.762 mm.) resulting in an air flow rate of about 0.23 standard cubic feet per minute (scfm) (0.109 liters/sec). However, it has been further empirically determined that an input air pressure within a range of 10–30 psig (0.703–2.109 kgs/square centimeter) will still establish a suitable gas bearing for this embodiment. Variations in the air due to pressure and temperature, and changes in housing geometric configuration and air flow rate may still be utilized to establish a suitable gas bearing, with spacings that may even exceed 0.004 inch (0.1016 mm.).

Such a processor 20 as herein described provides a heat source to develop a fixed photographic image with minimum variation in the film development process as well as providing a gas bearing support for the film in processor 20. Film 12 is conductively heated by a uniform transfer of heat from processor 20. This condition of uniform heat transfer is achieved by maintaining a constant heat transfer coefficient over the surface of the film upon which air impinges. The heat transfer coefficient is maintained uniform across the width of the film 12 by minimizing the temperature difference along the curved portion of housing 28 as well as along the spacing s. In a particular embodiment of the invention in which a dry silver film is utilized, development of a fixed photographic image is achieved by heating the film to a temperature between 210° F. (99° C.) and 330° F. (166° C.) at typical times ranging between 60 and 2 seconds.

To assure isothermal conditions of processor 20, undesirable losses of heat to the surroundings are to be minimized. In the above-described preferred embodiment of the invention as detailed in FIG. 5, a layer 74 of insulating material having poor thermal conduction properties is disposed around housing portion 32 and an insulating layer 76 similar to layer 74 is disposed around housing portion 34. Insulating layers 74 and 76 reduce the heat loss from the housing portions 32 and 34 respectively. A shield 78 and a shield 80 may be positioned around insulating layers 74 and 76 as safety precautions to operators.

To assure a condition of substantially uniform temperature of the air flowing into chambers 40 and 42 such that the air temperature is minimally altered by the housing 28 temperature, thermofoil heaters 82 and 84 are intimately disposed around housing portion 32 and 34 respectively. Thermofoil heaters, as well known in the art, typically comprise thin wires as heating elements embedded in a flexible, sheet-like electrically insulative material. Such thermofoil heaters may be formed around and attached to structural members which are to be heated. The wires of the thermofoil heaters 82 and 84 are generally connected to a source (not shown) of electrical energy to provide current to the wires for the generation of heat. Thermofoil heaters 82 and 84, when energized by a selected current, provide a uniform heat source over the entire surfaces they contact, heating thereby housing portions 32 and 34. Thus, the temperature of the housing portions 32 and 34 can be heated at substantially the same temperature as the supply air temperature so that the heat gradient is substantially or nearly zero, minimizing thereby the heat loss from the supplied air. To further assure isothermal conditions of processor 20, isothermal guards 86 and 88 may be positioned around thermofoil heaters 82 and 84 respectively. Guards 86 and 88 are formed of a material having good thermal properties such as copper, for example, and serve as "heat capacitors" to store thermal energy and uniformly distribute the heat about the portions 32 and 34.

To maintain the desired control of the air and processor housing 28 temperatures for the isothermal conditions, both the air temperature and housing temperature may be measured and controlled by electronic temperature sensing devices. For such purposes a thermistor 90 is located in housing 28 such as within isothermal guard 88 as shown in FIG. 5 and a pair of thermistors 92 and 94 are positioned in cavity 44 (FIG. 3). Thermistors 90, 92 and 94 sense the housing and air temperatures respectively and are connected in a suitable control circuit not shown to energize heater 50 and thermofoil heaters 82 and 84. Thermistor 90, sensing the temperature of the housing, electronically controls the thermofoil heaters 82 and 84, turning them on and off at the desired housing temperature. Thermistors 92 and 94 electronically control heater 50, turning it on and off at the desired air temperature. Control of the housing 28 and air temperature in this manner allows for a minimum temperature gradient between the heated air and housing 28.

Figure 6:
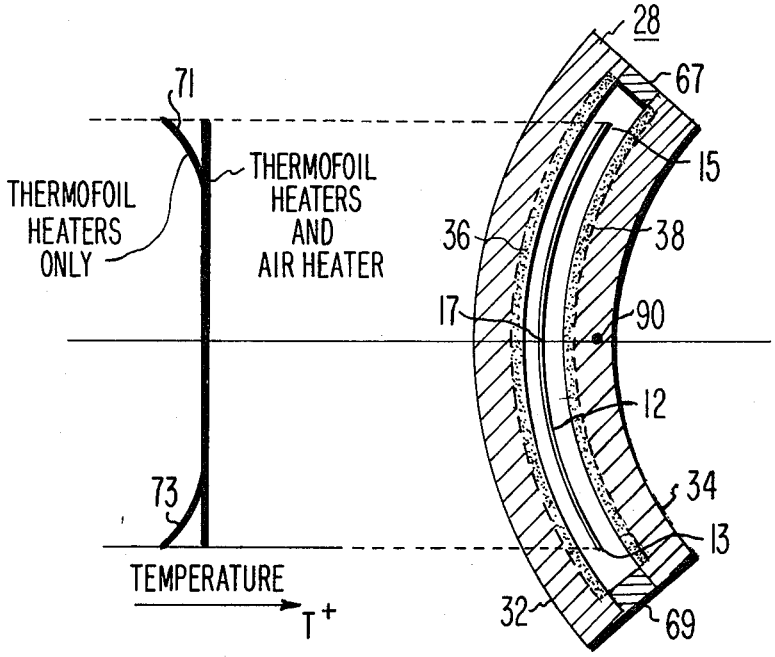
FIG. 6 is a graph of the temperature profile of a thermal processor according to one embodiment of the invention.

For further reduction in heat losses, in particular at the width extremities (13, 15) of film 12, porous members 36 and 38 are formed to have a width greater than the width of film 12 and members 36 and 38 are disposed such that their width extremities project beyond the width extremities, that is, the edges of film 12. With the only thermofoil heaters 82 and 84 on, the heat loss as indicated by the relative temperature (T) at both ends (13, 15) of film 12 is greater as compared to the heat loss at the center 17 of film 12 as shown by the graph in FIG. 6. This end loss is due to the ambient conditions and construction details at the housing ends (67, 69) which are more difficult to insulate. The heat loss at the film ends (13, 15) are shown in the graph of FIG. 6 as curved temperature portions 71 and 73. The loss of heat at the ends of the film results in a reduction of temperature, as shown by the graph. The curved temperature profile (71, 73) is adjusted or compensated for by the introduction of the heated air. As the heated air is supplied at housing ends 67 and 69 at a temperature in excess of the center temperature of isothermal guard 88 (location of thermistor 90), heat energy is absorbed by colder sections (67, 69) of housing 28. As the ends 67 and 69 of housing 28 increase in temperature, heat losses from the supplied heated air decrease, and the film 12 temperature profile become substantially isothermal.

Thermal processor 20 as hereinbefore described may be fabricated on a stand 96 (FIG. 3) for mounting in a desired film development system. Housing 28 may be supported by bracket 98 which is secured to stand 96 and heating station 46 may be supported by bracket 100 which is fastened to stand 96.

According to the present invention, thermal processor 20 may be utilized in a film development system which utilizes heat-processing for image development and which does not require application of external liquid developing agents. At present, black and white film is heat developable in a "dry" heat development process and may be utilized in the present invention. Color film is developable at present by "wet" processes which require the application of chemical agents for image fixation. It should be understood however, that the present invention is not limited to the processing of black and white film but may be utilized with any photographic film coated with a photothermally sensitized emulsion and developable in a dry heat process.

What is claimed is:

1. A thermal processor in an apparatus for heat development of a fixed photographic image on a strip of photographic film, said film including a latent image formed on an emulsion layer coated on a film base, comprising:

means for heating a supply of gas to a substantially uniform predetermined temperature;

a housing arranged to receive said gas;

means for supplying said gas to said housing;

gas distribution means responsive to said supply means for uniformly distributing said gas to said film at a predetermined pressure, said gas distribution means being supported by said housing and disposed adjacent to and on opposite surfaces of said film at a spacing such that said pressure of gas supplied to the respective surfaces of said film is sufficient to establish a gas bearing on said respective film surfaces to thereby support said film while being passed through said processor, and to transfer heat from said heating means to said respective surfaces of said film; and a thermofoil heater disposed around said housing to provide a heat source around the housing surface in contact with said gas tending to minimize heat loss from said heated gas;

whereby said heated gas heats both surfaces of said film substantially uniformly for development of said fixed photographic image.

2. A thermal processor according to claim 1, wherein said spacing between said gas distribution means and said emulsion and film base respectively is in the order of 0.002 inch (0.0508 mm.).

3. A thermal processor according to claim 1, wherein said gas distribution means has a width greater than the width of said film, said gas distribution means being disposed such that the width extremities of said gas distribution means projects beyond the width extremities of said film, and wherein said means for supplying said gas further comprises means to supply gas at each width extremity of said gas distribution means to reduce the heat loss at each width extremity of said film.

4. A thermal processor according to claim 1, further including an isothermal guard of thermally conductive material disposed about said thermofoil heater to retain and distribute the heat from said thermofoil heater providing thereby substantially isothermal gas conditions.

5. A thermal processor according to claim 4, further including a thermistor disposed in said housing and connected to said thermofoil heater to electronically sense and control the temperature of said housing.

* * * * *